United States Patent [19]

Feldhaus

[11] Patent Number: 4,808,268

[45] Date of Patent: Feb. 28, 1989

[54] APPARATUS FOR CLEANING COKE OVEN LEVELING DOORS AND LEVELING DOOR FRAMES

[75] Inventor: Karl Feldhaus, Gelsenkirchen, Fed. Rep. of Germany

[73] Assignee: Gewerkschaft Schalker Eisenhutte, Gelsenkirchen, Fed. Rep. of Germany

[21] Appl. No.: 67,415

[22] Filed: Jun. 22, 1987

Related U.S. Application Data

[63] Continuation of Ser. No. 822,298, Jan. 24, 1986, abandoned.

[30] Foreign Application Priority Data

Jan. 25, 1985 [DE] Fed. Rep. of Germany ..... 3502488

[51] Int. Cl.[4] ..... C10B 43/02

[52] U.S. Cl. ..... 202/241; 15/93 A

[58] Field of Search ..... 202/239, 241, 242, 246; 15/93 A; 110/176; 212/166

[56] References Cited

U.S. PATENT DOCUMENTS

| | | | |
|---|---|---|---|
| 3,972,781 | 8/1976 | Gouge et al. | 202/241 |
| 4,276,123 | 6/1981 | Emery | 202/241 |
| 4,372,819 | 2/1983 | Irwin | 202/239 |
| 4,552,622 | 11/1985 | Kwasnik et al. | 202/241 |

FOREIGN PATENT DOCUMENTS

| | | | |
|---|---|---|---|
| 17071 | 10/1980 | European Pat. Off. | 202/241 |
| 2144949 | 3/1973 | Fed. Rep. of Germany | 202/241 |
| 30884 | 2/1984 | Japan | 202/241 |
| 218117 | 8/1968 | U.S.S.R. | 202/241 |

*Primary Examiner*—David L. Lacey
*Assistant Examiner*—Joye L. Woodard
*Attorney, Agent, or Firm*—Browdy and Neimark

[57] ABSTRACT

An apparatus is provided for cleaning the leveling doors and leveling door frames of coking chambers in a coking oven. The coking oven has a leveling device located on the machine side with a leveling rod and a device for supporting and pushing the leveling rod. The leveling device is preferably movable in the longitudinal direction of the coking oven. The leveling doors are pivotably articulated on the leveling door frames, and each is provided with a closing device.

9 Claims, 11 Drawing Sheets

APPARATUS FOR CLEANING COKE OVEN LEVELING DOORS AND LEVELING DOOR FRAMES

This application is a continuation of application Ser. No. 822,298, filed Jan. 24, 1986, now abandoned.

FIELD OF THE INVENTION

The invention relates to an apparatus for cleaning the leveling doors and leveling door frames of coking chambers in a coking oven. The coking oven has a leveling device located on the machine side with a leveling rod and a device for supporting and pushing the leveling rod. The leveling device is preferably movable in the longitudinal direction of the coking oven, in particular being arranged on a coke pressing (pushing) machine that is movable in the longitudinal direction of the coking oven. The leveling doors are pivotably articulated on the leveling door frames, preferably being pivotable upward, and each is provided with a closing device.

BACKGROUND OF THE INVENTION

The coking oven of the above type is a horizontal chamber oven for self-feeding operation from a hopper above it and having a multiplicity of coking chambers disposed adjacent one another in a long line. When the coking chambers are filled from coking coal carriages, pointed mounds of material build up in the coking chambers under the coal feed openings; these mounds must be leveled so that the space in the coking chamber can be properly utilized. Leveling devices are used for this purpose, being almost always disposed on the machine side of the coking chambers, that is, on the side near the coke pressing machine, either on a movable carriage of their own or on the coke pressing machine itself. For leveling, the leveling rod of a leveling device is introduced into the interior of the coking chamber through an opening, called the leveling opening, in the upper portion of the door near the machine of the particular coking chamber and is then moved back and forth inside the coking chamber so that the pointed mound of material is levelled off. After the leveling operation is finished, the leveling rod is retracted back out of the coking chamber, and the leveling opening is closed in a largely gas-tight manner by means of a leveling door. The leveling door comes to rest in a sealing manner on the leveling door frame provided on the oven door; typically, the sealing action is obtained by means of sealing frames made from band iron.

Like the doors and door frames of the coking chambers themselves, the leveling doors and leveling door frames of coking chambers become soiled with particles of coke and tar that stick to them. This soiling is not as serious as that of the doors and door frames of the coking chambers themselves, and so manual cleaning from time to time was previously thought adequate. Hand-guided scrapers were used as cleaning tools. It will be appreciated that such unpleasant work was generally done quite seldom.

An increasing awareness of environmental considerations and more stringent regulations having to do with protecting the environment have had the effect that even the relatively low emissions through the leveling doors and leveling door frames of the coking chambers of a coking oven resulting from soiling can no longer be considered acceptable. On the other hand, increasingly stringent occupational safety rules do not allow cleaning of the leveling doors and leveling door frames with manual cleaning devices at shorter intervals. It is accordingly the object of the invention to provide a largely automatable cleaning apparatus that is designed specifically for the special requirements of leveling doors and leveling door frames.

SUMMARY OF THE INVENTION

The cleaning apparatus according to the invention, which attains the above object, is characterized according to the fundamental teaching of the invention in that a door opening device, a positioning device, a door frame cleaning device and a door cleaning device are provided, and the positioning device, the door frame cleaning device and preferably the door cleaning device as well are movable in the longitudinal direction of the coking chambers relative to the door opening device.

The term "door opening device" is chosen because typically, and preferably, the leveling doors are pivotable on the leveling door frames, in particular being pivotable upward. Thus all that is needed is to open the leveling doors by swinging them up, not lifting them off as is the case with the doors of the coking chambers themselves. On the other hand, it is naturally conceivable that the leveling doors too may be opened by being lifted all the way off the leveling door frames and then swung out of the way to the side, for instance, or retracted a considerable distance backward away from the leveling door frames. In that case, the teaching of the invention applies accordingly, and the "door opening device" would be a "door opening and lifting-off device". Finally, it is of course also possible that the leveling doors may be articulated such that they are pivotable to the side or downward on the leveling door frames. However, pivoting them upward is particularly advantageous in a horizontal chamber oven, because that provision makes optimal use of the available space.

For the teaching of the invention, the positioning device is also particularly important; this device assures that the door frame cleaning device and preferably the door cleaning device as well are moved into the correct position relative to the leveling door frame and the leveling door. Thus the positioning device enables an automatable positioning of the entire cleaning apparatus at the various leveling door frames. The appearance of this positioning device in accordance with the preferred teachings of the invention will be described in further detail hereinafter.

Finally, another essential factor for the teaching of the invention is that the positioning device, the door frame cleaning device, and preferably the door cleaning device as well are movable relative to the door opening direction in the longitudinal direction of the coking chambers. This feature of the teaching of the invention takes due account of the fact that in terms of the sequence of events, first the leveling door is opened by means of the door opening device, in a preferred embodiment of the invention thus having to be pivoted upward, and only thereafter can the positioning device, the door frame cleaning device and preferably also the door cleaning device be moved into position or in other words move toward the leveling door frames. Thus while the door opening device remains more or less in a position of repose, the positioning device, the door frame cleaning device and preferably the door cleaning device as well move relative to the door opening device. The details of how this is achieved, and how the door frame cleaning device and the door cleaning device are embodied in accordance with the preferred teaching of the invention, will be provided hereinafter.

Particularly preferred and suitable embodiments and variants of the teaching of the invention are described in detail in the ensuing description of preferred exemplary embodiments of the invention, taken in conjunction with the drawings.

DESCRIPTION OF THE PREFERRED EMBODIMENTS

Figure 1:
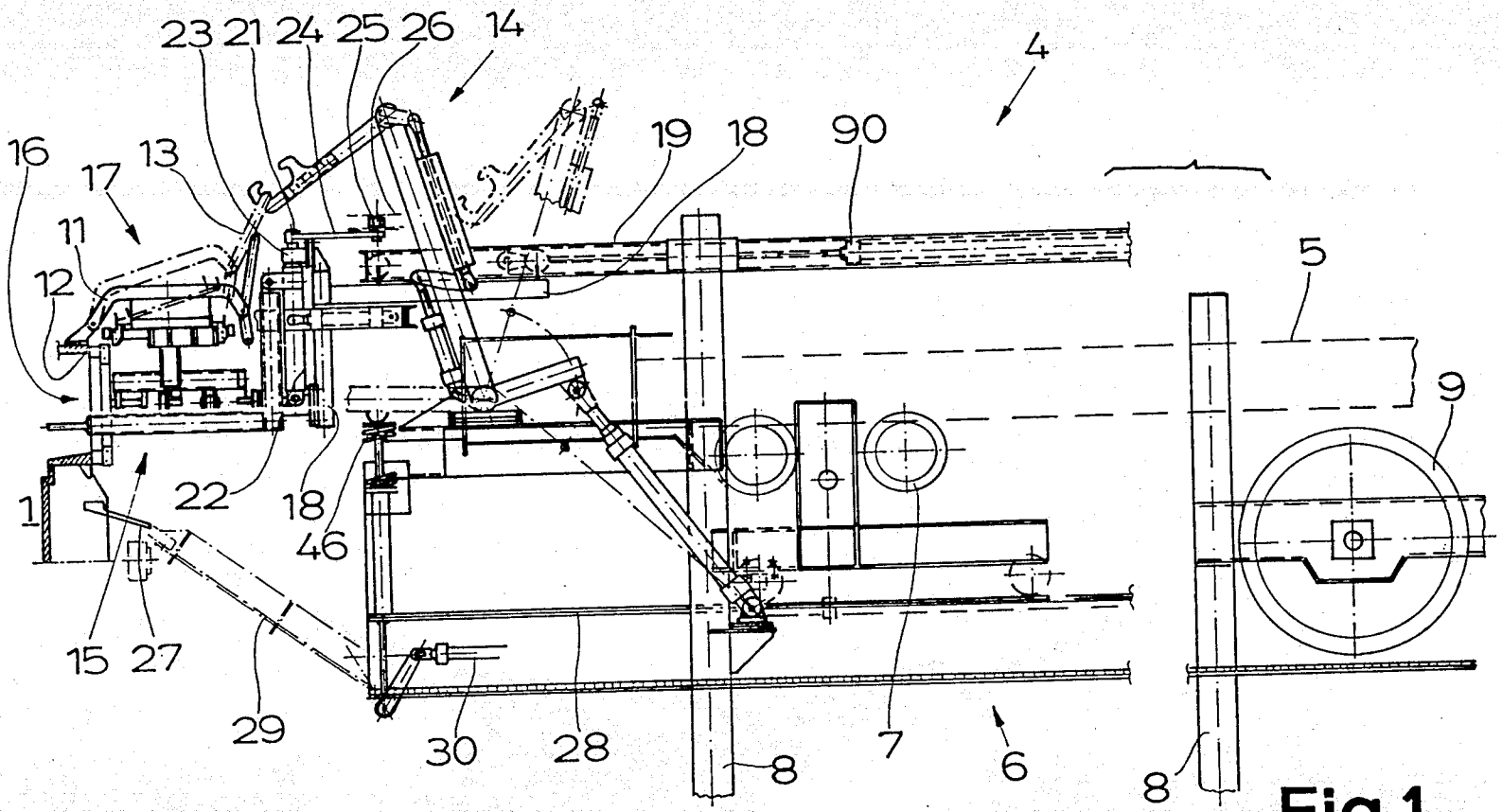
FIG. 1, in highly schematic fashion, shows a side view of the machine side of a coking chamber of a coking oven having a cleaning apparatus according to the invention.
Figure 2:
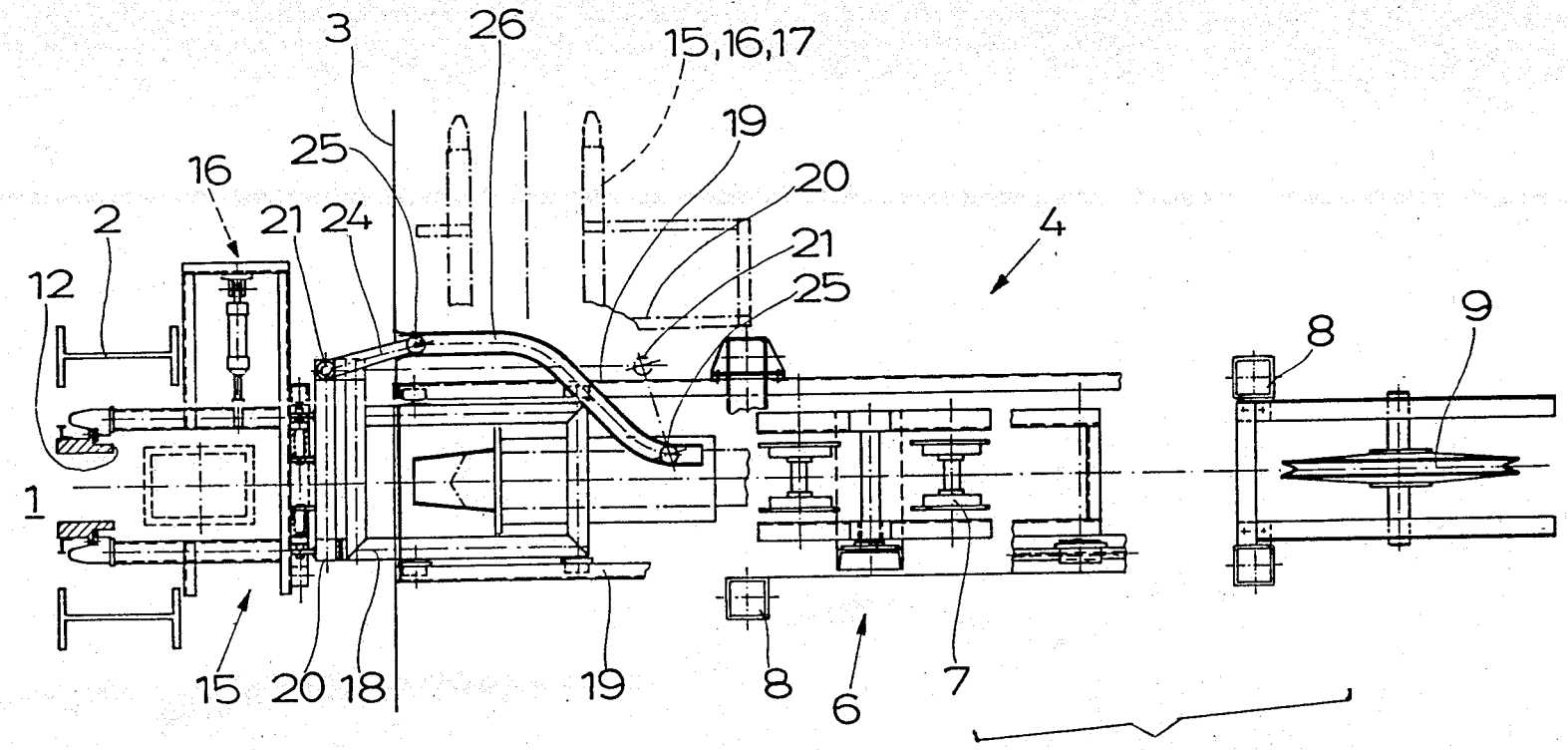
FIG. 2 is a plan view of the subject of FIG. 1, with various elements left out of the illustration for the sake of clarity.

In FIGS. 1 and 2, the machine side of a coking oven is shown. On the left-hand edge of FIGS. 1 and 2, a coking chamber 1 and two anchoring stands 2 defining the coking chamber 1 are visible. These drawings also indicate schematically that a coke pressing (pushing) machine 3 is provided which is movable in the longitudinal direction of the coking oven. Disposed on this coke pressing machine 3 (coke pushing machine) is a leveling device 4 having a leveling rod 5 and a device 6 for supporting and pushing the leveling rod 5. Support rollers 7 and stands 8 are also shown, as well as a rope guide roller 9 of the leveling device 4, this roller 9 being disposed far from the rollers 7 and stands 8.

In accordance with the invention, a cleaning apparatus is provided, which serves to clean a leveling door 11 and a leveling door frame 12 of the coking chamber 1. The leveling door frame 12 is part of an oven door, not shown in further detail, of the coking chamber 1. In the exemplary embodiment shown, the leveling door 11 is articulated such that it is upwardly pivotable on the leveling door frame 12 and it is provided with a closing device 13.

The cleaning apparatus is a replacement, in accordance with the invention, for the manually operated cleaning devices used in known coking ovens for the leveling doors and leveling door frames and it is combined with a door opening device 14 and includes a positioning device 15, a door frame cleaning device 16 and a door cleaning device 17, which represent the fundamental elements of the cleaning apparatus according to the invention.

As FIGS. 1 and 2 show, the positioning device 15, the door frame cleaning device 16 and the door cleaning device 17 are movable in the longitudinal direction of the coking chamber 1 relative to the door opening device 14.

As FIGS. 1 and 2 also show, the cleaning apparatus is combined with the leveling device 4, that is, being disposed in common with it on the coke pressing machine 3. If one looks carefully at FIGS. 1 and 2, one will even see that the cleaning apparatus is integrally arranged with the leveling device 4, that is, that the leveling device 4 on the one hand and the cleaning apparatus on the other are provided with structure to operate in a reciprocal fashion, as explained in the following. Nevertheless, it is naturally entirely possible for the cleaning apparatus to be completely separate from the leveling device, even to the extent that the cleaning apparatus may have its own drive carriage that is movable in the longitudinal direction of the coking oven. On the other hand, the fact that integrating the leveling device 4 and the cleaning apparatus has both structural and operational advantages is self-evident.

A first structural advantage of the preferred teaching of the invention as shown is that the door opening device 14 is associated with both the leveling device 4 and the cleaning apparatus. This dual utilization of the door opening device 14 is exploited by the invention because in order for the leveling rod 5 to be introduced into the coking chamber 1, the leveling door 11 must be opened. Thus a door opening device provided for the leveling device 4 can also be used for the cleaning apparatus, or, as provided in accordance with the invention, a door opening device 14 provided for the cleaning apparatus can also be used together with the leveling device 4.

If the cleaning apparatus is located in front of the open leveling door 11, then the movement path of the leveling rod 5 is blocked. According to the preferred teaching of the invention, the positioning device 15, the door frame cleaning device 16 and the door cleaning device 17 of the cleaning apparatus are pivotable into and out of the path of movement of the leveling rod 5. This pivoting movement is preferably effected in a substantially horizontal plane, or in other words to the side, out of the way of the movement path of the leveling rod 5.

It was explained above that the positioning device 15, the door frame cleaning device 16 and the door cleaning device 17 are movable relative to the door opening device 14. FIG. 2 taken together with FIG. 1 shows that a shared main carriage 18 that is movable in the longitudinal direction of the coking chamber 1 is used for this purpose. The main carriage 18 runs on rollers in main rails 19, which extend on the coke pressing machine 3 in the longitudinal direction of the coking chamber 1. In the exemplary embodiment shown, the main carriage 18 and the main rails 19 are located above and/or to the side of the movement path of the leveling rod 5, in any case such that its movement is not hindered when the positioning device 15 is pivoted out.

FIGS. 1 and 2 show that the main carriage 18 is not pivoted out along with the positioning device. However, Figs. 1 and 2 also show how the outward pivoting of the positioning device 5 is realized in the illustrated exemplary embodiment. To accomplish this, the positioning device 15, the door frame cleaning device 16 and the door cleaning device 17 are disposed on a carrier 20 that is pivotably articulated on the main carriage 18, specifically being pivotable in a substantially horizontal plane. The carrier 20 comprises a bearing shaft 21 and a supporting frame 22 projecting from the bearing shaft 21 and located substantially in a vertical plane. The bearing shaft 21 is retained in upper and lower bearings 23 on the main carriage 18. In other words, the carrier 20 is supported at one end by means of the bearing shaft 21, which should be relatively solid or massive; this is shown in FIG. 2.

The pivoting movement of the carrier 20 relative to the main carriage 18 could in principle be effected by its own pivoting drive. According to the preferred teaching of the invention, however, the pivoting movement of the carrier 20 is automatically controlled by the movement of the main carriage 18 in the longitudinal direction of the coking chamber 1. FIGS. 1 and 2, taken together, show that the carrier 20 has to this end a pivot lever 24 attached at a rigid angle and guided at its end, with a roller 25, in a control slot 26. The control slot 26 is disposed stationary on the coke pressing machine 3, so that the pivoting movement of the carrier 20 relative to the main carriage 18 is automatically derived from the driven movement of the main carriage 18 in the longitudinal direction of the coking chamber 1.

As FIG. 2 shows, the pivot lever 24 projects at an obtuse angle, in the exemplary embodiment shown, from the carrier 20. The control slot 26 intersects the path of movement of the bearing shaft 21. This does no harm, however, because as FIG. 1 again shows, the roller 25 projects upward from the pivot lever 25, and the control slot 26 is disposed above the movement path of the main carriage 18. The outwardly pivoted position of the positioning device 15, the door frame cleaning device 16, the door closing device 17, the carrier 20 and the roller 25 is clearly shown in dot-dash lines in FIG. 2. In this position, the path of movement of the leveling rod 5 is completely unhindered.

By comparing the solid lines with the dot-dash lines in FIG. 1, it will be seen that the leveling door 11 can be pivoted by the door opening device 14 into an insertion position, for the insertion and retraction of the door cleaning device 17. This insertion position is shown in FIG. 1 in dotdash lines. After the insertion of the door cleaning device 17, the leveling door 11 can be pivoted backward into a cleaning position, so that it can be cleaned. This position is a horizontal one, in the exemplary embodiment shown here, and it is shown in FIG. 1 with solid lines. According to the preferred teaching of the invention, the door cleaning device 17 operates in a substantially horizontal plane.

Finally, FIGS. 1 and 2 also show that the door frame cleaning device 16 and the door cleaning device 17 come into action substantially simultaneously. This corresponds to the preferred exemplary embodiment having a leveling opening with a leveling door 11 that is articulated on the leveling door frame 12 such that it is upwardly pivotable. Thus with the leveling door 11 located in the insertion position, the entire cleaning apparatus is brought up to the door—that is, positioned—and then the leveling door 11 is lowered onto the door cleaning device 17, and the cleaning of the leveling door frame 12 and of the leveling door 11 itself takes place more or less simultaneously.

FIG. 1 finally shows still another position, in which the door opening device 14 can be moved. This is a position of repose, in which the door opening device 14 is pivoted back onto the coke pressing machine 3.

FIG. 1 further shows that to attain an automatable function of the cleaning apparatus according to the invention, hydraulic cylinder-piston arrangements are provided to generate the movements of the various elements of the cleaning apparatus. Naturally electrical linear drive mechanisms, rotary drive mechanisms, pneumatic drive mechanisms and the like may be provided, instead of hydraulic drive mechanisms. However, hydraulics using water has become largely standard in coke oven construction, so that hydraulic drive mechanisms of this kind are particularly advantageous for the cleaning apparatus according to the invention.

Limit switches, which may be particularly embodied in the form of proximity switches actuated without contact, are used for controlling the movement of the various elements of the cleaning apparatus.

Before describing individual details of preferred exemplary embodiments of a cleaning apparatus according to the invention, it should be noted again in conjunction with FIG. 1 that a chute 27 is provided below the leveling door frame 12, as well as a slide 29 that can be brought close to the chute 27 and is located on a carrier 28 of the door opening device 14 or on the coke pressing machine, so as to catch falling residues from cleaning. The slide 29 can be pivoted into place next to the stationary chute 27 by a hydraulic drive mechanism 30.

A particularly preferred exemplary embodiment of a door opening device 14 will now be described in detail, referring to FIGS. 3 and 4. These drawing figures show a leveling door 11, a leveling door frame 12, a closing device 13, the door opening device 14, a chute 27 and a carrier 28 for the door opening device 14 on a coke pressing machine 3 not otherwise shown.

Figure 3:
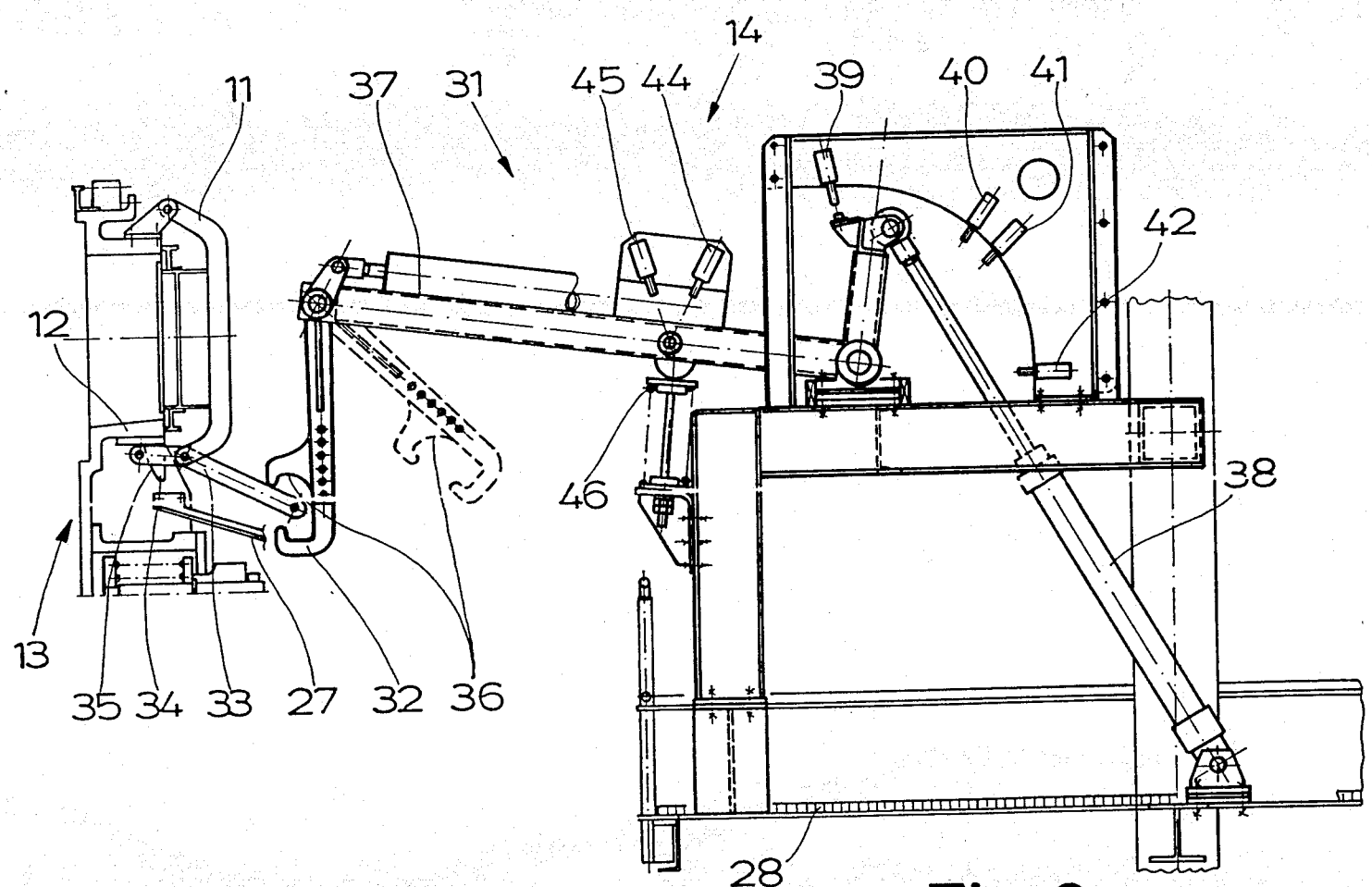
FIG. 3 is a highly schematic side view, on a larger scale, of a door opening device with a leveling door shown in its closed position.

FIG. 3 shows the door opening device 14 with a leveling door 11 in the closed position. The door opening device 14 has a rod linkage 31, which is pivotable in a vertical plane and is disposed to be stationary on the coke pressing machine 3, that is, on the carrier 28, and also has a gripping claw 32 for the closing device 13 of the leveling door; the gripping claw 32 is pivotably articulated on the rod linkage 31 and is pivotable relative to the rod linkage 31, again in a vertical plane. The exemplary embodiment shown has a central closing device 13 on the leveling door 11, and therefore a gripping claw 32 is also shown in detail. Naturally it is equally possible for a plurality of gripping claws 32 to be associated with a plurality of closing devices 13 of a leveling door 11. It is then within the competence of one of average skill in the art to embody the rod linkage 31 appropriately.

Figure 4:
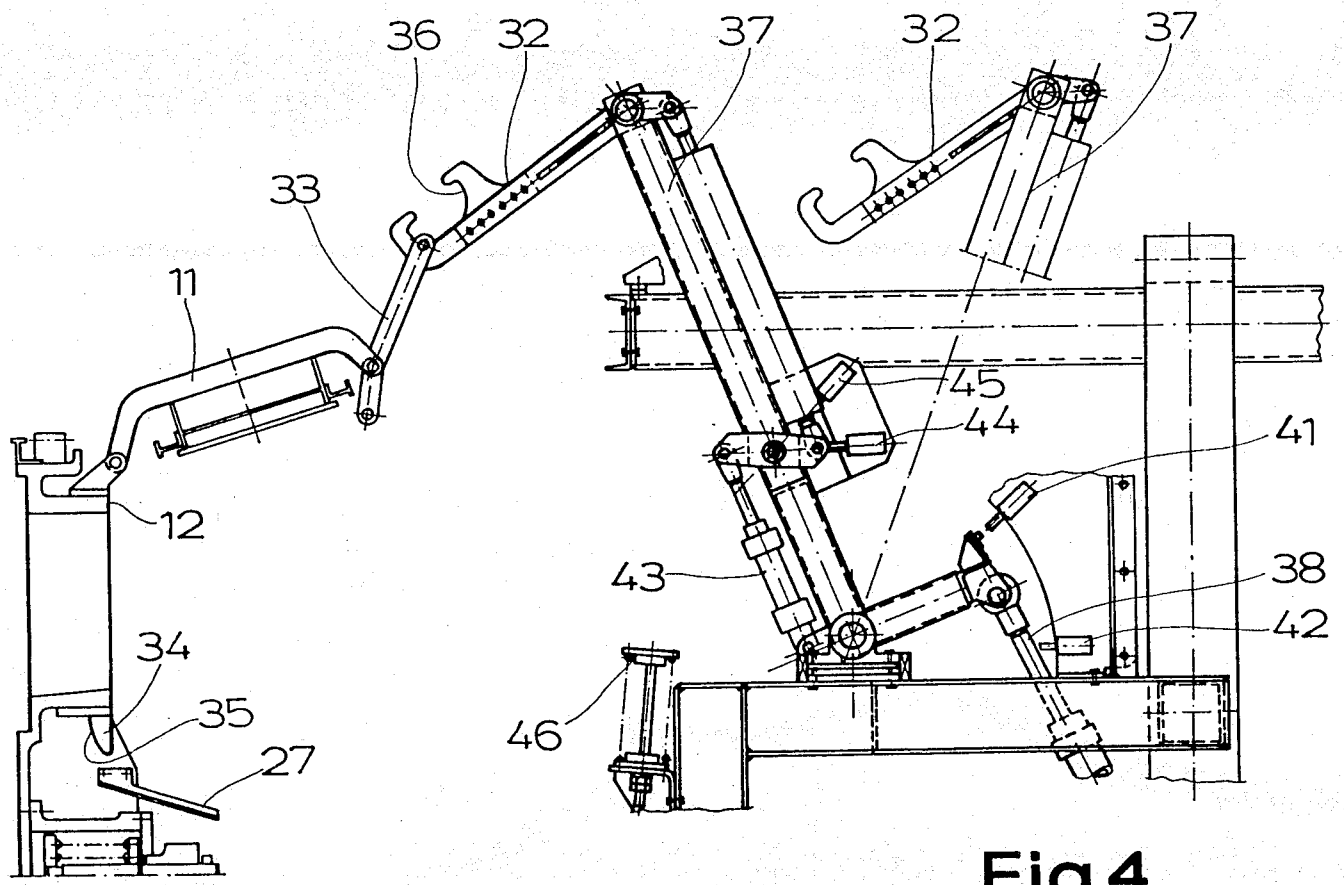
FIG. 4 shows the subject of FIG. 3 with a leveling door in the insertion position, that is, in its position of repose.

FIGS. 3 and 4 as well as FIGS. 1 and 2 indicate that the rod linkage 31 of the door opening device 14 is disposed substantially to the side of the movement path of the leveling rod 5 and that it has an extension arm overlapping the movement path of the leveling rod 5 and carrying the gripping claw 32. If it were shown, the rod linkage 31 would be disposed next to the path of movement of the leveling rod 5 at the bottom of FIG. 2, that is, on the side of the movement path of the leveling rod 5 that is remote from the outwardly pivoted position of the positioning device 15. Naturally, if for instance only one centrally arranged closing device 13 is provided on the leveling door 11, then the extension arm that carries the gripping claw 32 would also overlap the positioning device 15, and in particular the main carriage 18 as well.

FIGS. 3 and 4 show that the closing device 13 on the leveling door 11 is embodied here in a manner that is suitable particularly for an upwardly pivotable leveling door 11. The closing device 13 here is embodied as a bracket-like two-arm lever 33 pivotably articulated on the leveling door 11. The two-arm lever 33 grips a closing hook 34 on the leveling door frame 12 from behind with one lever arm, in this case its shorter lever arm. With the other, in this case its longer lever arm, the two-arm lever 33 forms a point of application for the door opening device 14, that is, in this case the gripping claw 32 of the door opening device 14. In the closed position of the leveling door 11, the different lengths of the lever arms of the two-arm lever 33, presuming that both are made of the same material, effect a self locking, because of the torque being exterted in the closing direction.

Taken in conjunction with one another, FIGS. 3 and 4 show that the closing hook 34 has a control face 35 extending in a curve it the closing direction, so that by rotating the two-arm lever 33 clockwise, the leveling door 11 is automatically moved into place in a sealing manner at the leveling door frame 12. As FIGS. 3 and 4 show, the gripping claw 32 also has a downwardly curved control face 36 that comes to rest, during a closing movement, at the end of the other lever arm. By means of this control face 36, the lever arm can be pressed downward and in the direction of the leveling door frame 12, in other words such as to reinforce the closing movement of the leveling door 11. The final, fully closed position of the leveling door 11 is shown in FIG. 3.

Taken in detail, FIG. 3 now shows that the rod linkage 31 substantially comprises a two-arm lever 37 forming a rigid angle, on one arm of which the gripping claw 32 is articulated, while a first hydraulic drive mechanism 38 is articulated on its other arm. This hydraulic drive mechanism 38 serves to pivot the overall rod linkage 31. Its pivoting movement is controlled by the following proximity switches that are actuated without contact: 39, for the closed position; 40, for the cleaning position of the leveling door 11; 41, for the insertion position of the leveling door 11; and 42, for the position of repose. The gripping claw 32 can be pivoted relative to the rod linkage 31 into a gripping position (shown in solid lines in FIG. 3) and into a releasing position (shown in broken lines in FIG. 3). A second hydraulic drive mechanism 43 effects this; its movement is controlled by non-contactactuated proximity switches 44, for the gripping position, and 45, for the releasing position. A stop buffer 46 is also visible in the drawing.

Figure 5:
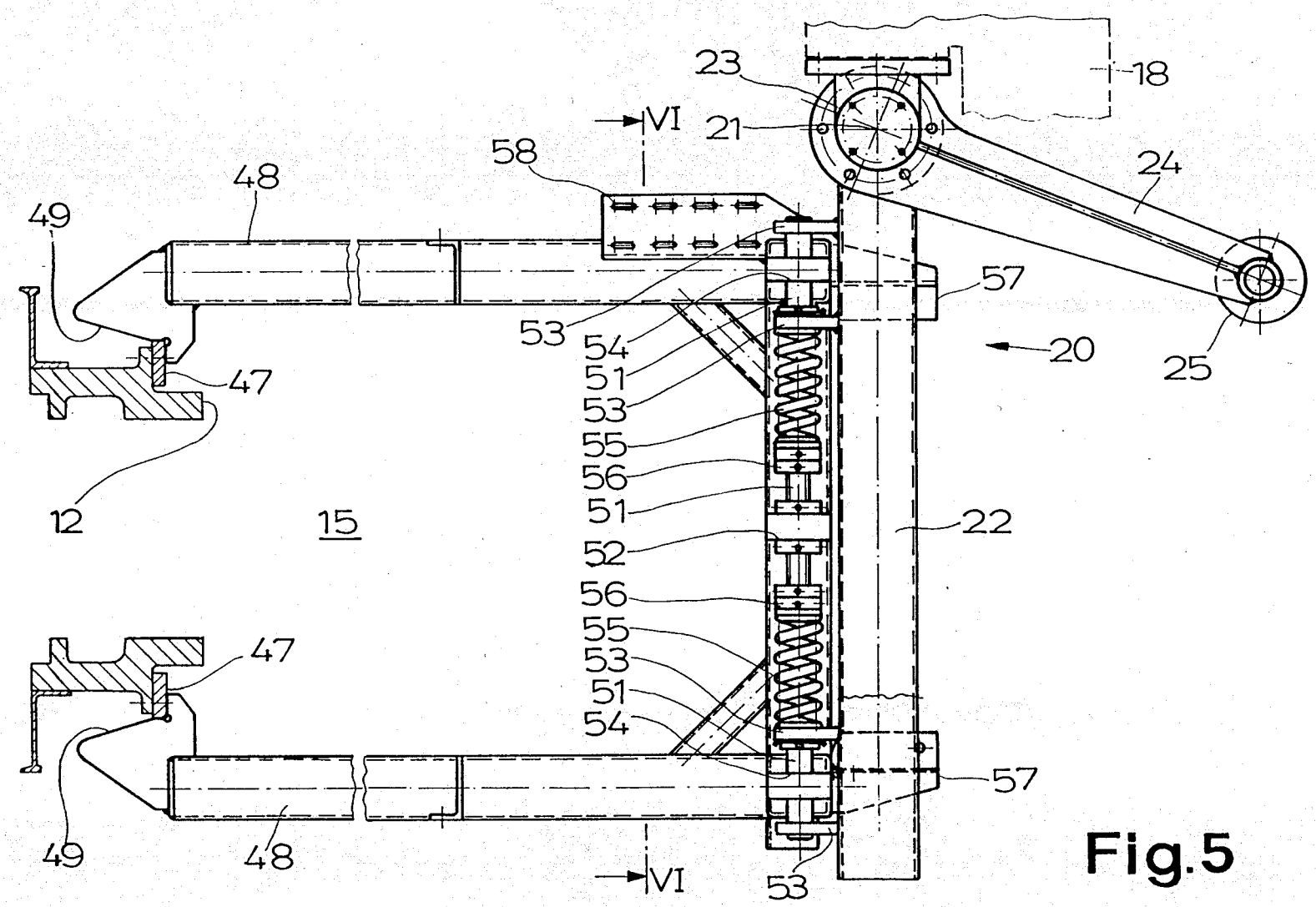
FIG. 5 is a plan view, on a larger scale, of a positioning device positioned against a leveling door frame and joined to a carrier.
Figure 6:
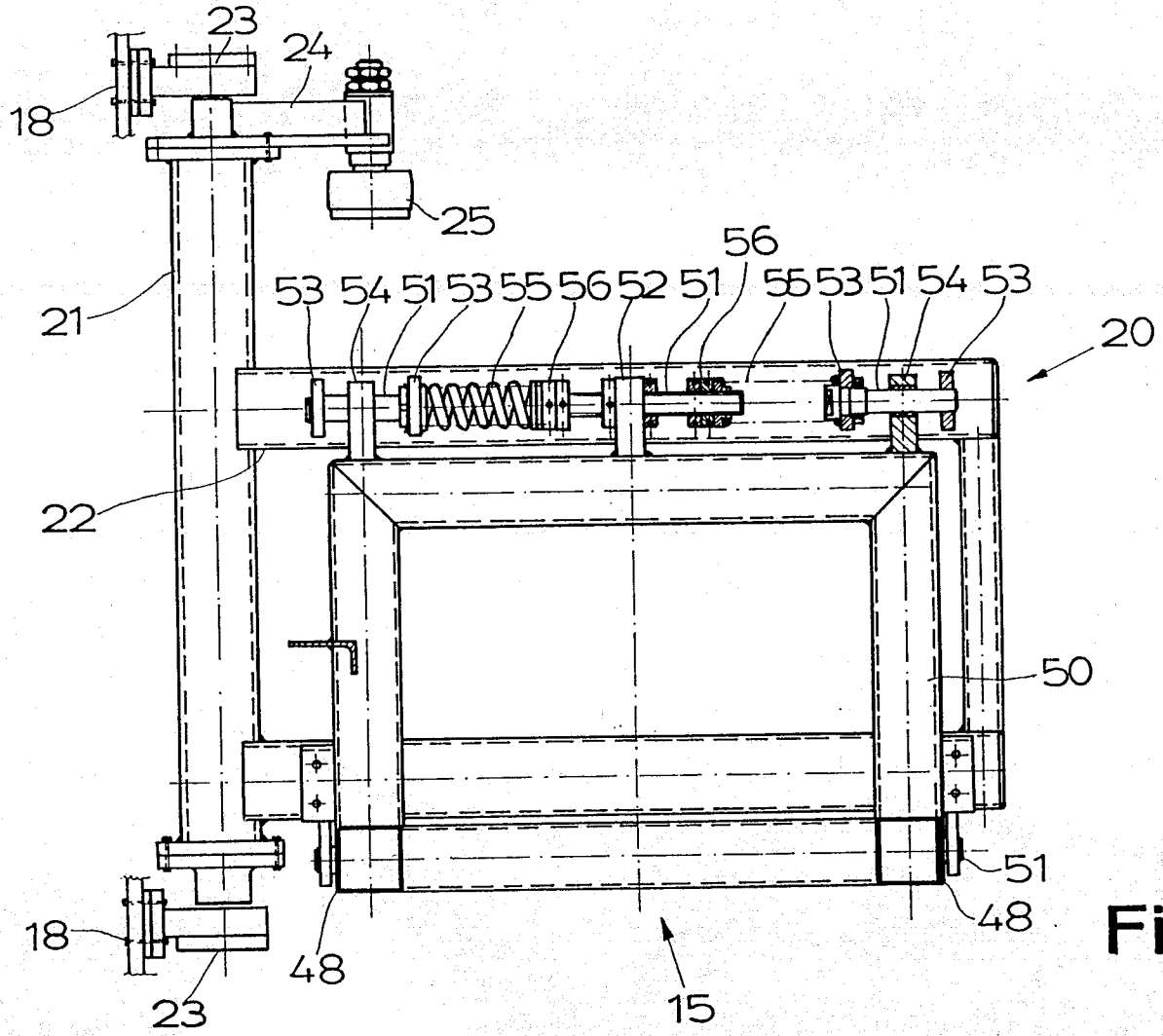
FIG. 6 is a section taken along the line VI—VI of the subject of FIG. 5.

FIGS. 5 and 6 will now be referred to, to explain how the pivoting of the carrier 20 relative to the main carriage 18 can be realized somewhat differently from what is shown in FIGS. 1 and 2. First, FIG. 5 shows somewhat more clearly than FIG. 1 the carrier 20, pivotably articulated on the schematically shown main carriage 18, along with the bearing shaft 21, the supporting frame 22, the upper bearing 23, the pivot lever 24 and the roller 25 disposed on the end of the pivot lever. The control slot, which of course is provided here as well, is not shown. Similar elements are shown in FIG. 6. Differing from the exemplary embodiment of FIG. 2, however, the pivot lever 24 here points obliquely inward; that is, it forms an acute angle with the supporting frame 22 of the carrier 20. As a result, the control slot 26 is also shifted inward with respect to the bearing shaft 21. Accordingly, the bearing shaft 21 cannot collide with the control slot (not shown here), because it does not intersect with it. Nor does the supporting frame 22 collide with the control slot, because as FIG. 6 shows, the roller 25 is disposed above the supporting frame 22.

The preferred positioning device 15 shown here has two straightening elements 48 projecting in tine-like fashion toward the leveling door frame 12, and they can be brought into contact with straightening faces 47 of the leveling door frame 12. The straightening elements 48 have run-on includes 49 oriented toward the straigtening faces 47. The distance by which the straightening elements 48 are spaced apart is matched to the desired distance by which the straigtening faces 47 are spaced apart from one another. Since coking ovens are not precision-engineered products, the tolerances that necessarily arise are compensated for by the inherent elasticity of the straightening element 48 in combination with the run-on inclines 49.

In the exemplary embodiment shown, the straightening elements 48 are part of a torsionally rigid positioning frame 50. The positioning frame 50 is shown in section from above in FIG. 5 and from the front in FIG. 6. If the positioning frame 50, and hence the positioning device 15, is correctly positioned at a leveling door frame 12, then an optimal alignment is provided for the entire cleaning apparatus 10. As a matter of fact, however, neither the coke pressing machine 3 nor a separate driving mechanism which may be provided for the cleaning apparatus can be positioned in front of a particular desired coking chamber or leveling opening within very close tolerances. Accordingly, to compensate for slight lateral tolerances, the positioning frame 50 is supported on the carrier 20 such that it can be adjusted by a predetermined amount crosswise to the direction of extension of the straightening element 48. Thus when the positioning element 15 is brought into position, the positioning frame 50 straightens out more or less automatically at the leveling door frame 12, by tht action of the run-on inclines 49 of the straightening elements 48.

The adjustability of the positioning frame 50 on the carrier 20 can be realized by means of its own hydraulic drive mechanism. The necessary adjusting force can instead, however, also be derived from the drive movement of the main carriage 18 in the longitudinal direction of the coking chamber 1. For attaining this, a suitable embodiment is characterized in that the positioning frame 50 has a respective bearing shaft 51 on its upper edge and preferably on its lower edge as well, the bearing shaft 51 being retained at least centrally in a block 52 that is secured on the positioning frame 50 and being slidably guided in bearing eyes 53 of the carrier 20 that are disposed on both sides of the block 52. In the exemplary embodiment shown, in addition to the central block 52 for each bearing shaft 51, two further, lateral blocks 54 are provided. Furthermore, in this case the adjustment of the positioning frame 50 relative to the carrier 20 is effected counter to the force of spring elements 55, thereby dictating a central normal position of the positioning frame 50. The spring elements 55 are disposed between the central block 52, or support rings 56 disposed on the bearing shaft 51 in a predetermined relative position with respect to the central block 52, on the one hand, and the next adjacent bearing eyes 53, on the other. The spring elements 55 in this embodiment are realized in the form of helical compression springs and they partly replace the bearing shafts 51.

Solely for the sake of completeness, it is also noted that the exemplary embodiment of a positioning device 15 shown here has securing flanges 57 and 58, which gain significance in combination with the door cleaning device 17 of this preferred exemplary embodiment of the invention.

Figure 7:
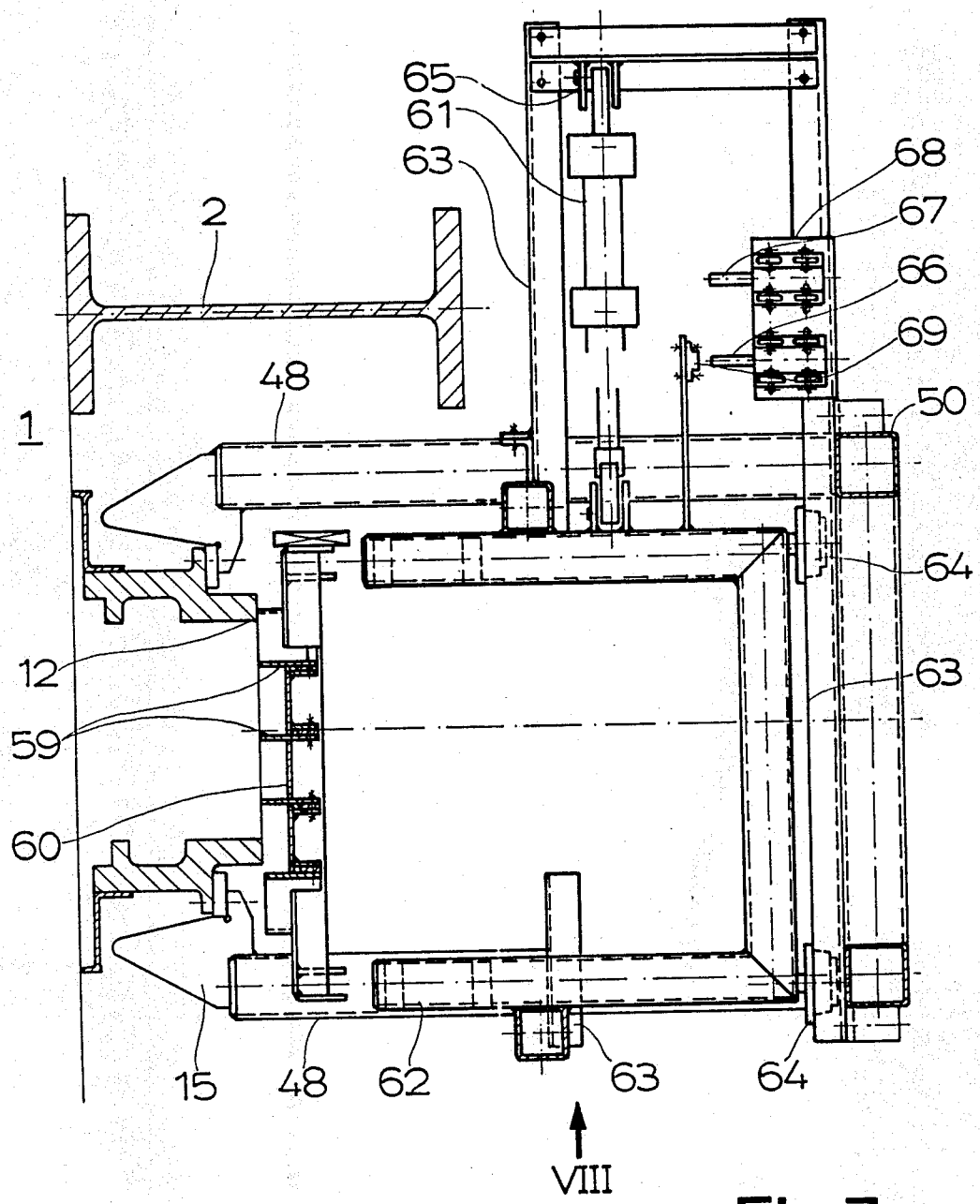
FIG. 7 shows a positioning device combined with a door frame cleaning device in a horizontal section but otherwise corresponding to the illustration in FIG. 5.

FIG. 7 shows an anchoring stand 2 and a leveling door frame 12 of a coking chamber 1 once again. The positioning device 15, with straightening elements 48 and positioning frame 50, is also shown here for the sake of clarifying the overall context.

FIG. 7 is actually intended, however, to explain the preferred embodiment shown here of a door frame cleaning device 16 according to the invention. For better comprehension of this door frame cleaning device 16, FIGS. 8, 9 and 10 will also be referred to.

The door frame cleaning device 16 realized in the cleaning apparatus according to the inention and in accordance with the exemplary embodiment shown here has, first, a cleaning head 60 that can be brought, with scrapers 59, into contact with the leveling door frame 12. Instead of mechanical action scrapers 59, naturally any other kind of cleaning elements can be used, such as hot steam nozzles, hot water nozzles and the like.

Figure 10:
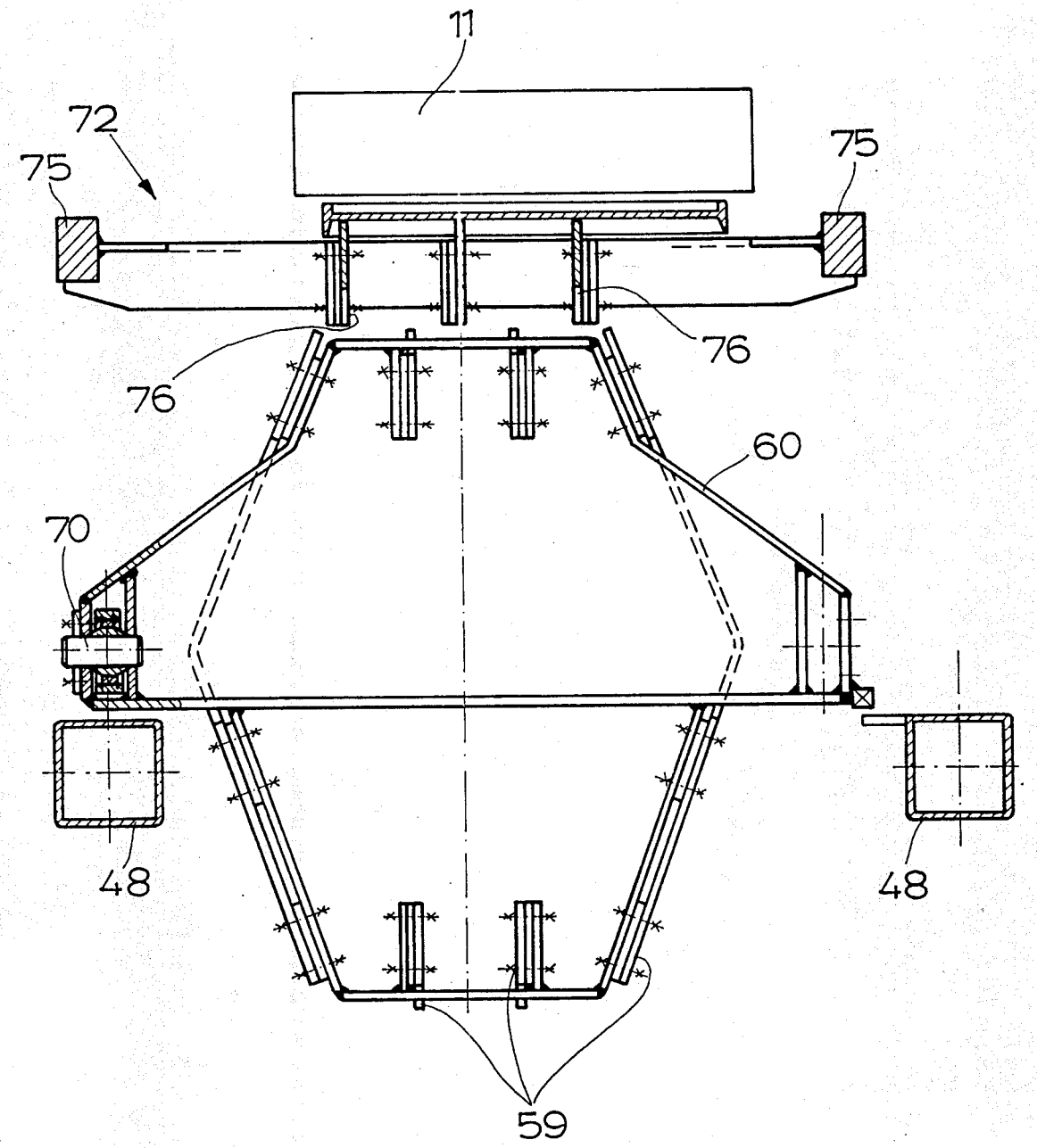
FIG. 10 shows the subject of FIG. 8 in a vertical section taken along the line X—X of FIG. 8.

FIG. 7 shows four scrapers 59 disposed adjacent to one another on the cleaning head 60 for the lower edge of the leveling door frame 12. The distance by which the scrapers 59 are spaced apart is selected such that one back-and-forth movement of the cleaning head 60 is just sufficient to clean the leveling door frame 12 completely. FIG. 10 shows the cleaning head 60 somewhat more clearly; the frame-like construction of the cleaning head 60 is quite clear, and it is also apparent that the scrapers 59 on the cleaning head 60 extend approximately vertically on the upper and lower edge of the leveling door frame 12, while on the side edges of the leveling door frame 12 they extend at an inclination to the vertical. This arrangement of the scrapers 59 on the cleaning head 60 has the advantage that only one back-and-forth movement of the cleaning head 60 in a horizontal direction is needed so as to clean the side edges of the leveling door frame 12 as well. Naturally, corresponding arrangements could also be made for moving the cleaning head 60 up and down instead of back and forth, or in other directions.

The back-and-forth movement of the cleaning head 60 is effected by a hydraulic drive mechanism 61 shown schematically in FIG. 7; this mechanism is operative for the movement in a plane crosswise to the longitudinal direction of the coking chamber 1 that is realized here.

Figure 8:
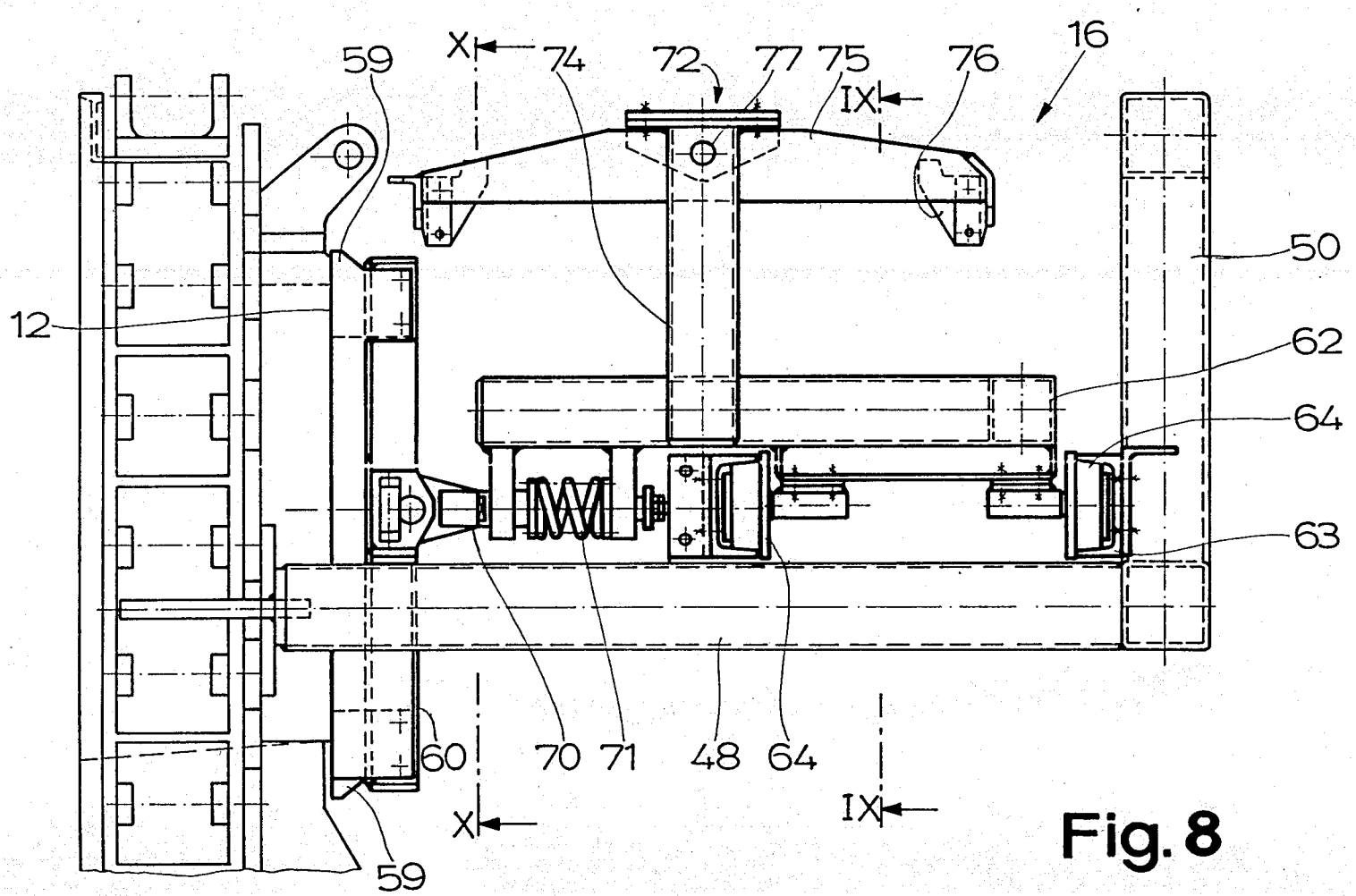
FIG. 8 shows the subject of FIG. 7 in a view from the direction indicated as VIII in FIG. 7.

Taken together, FIGS. 7 and 8 show that the door frame cleaning device 16 shown has a cleaning carriage 62 that is movable crosswise to the longitudinal direction of the coking chamber 1 and in particular in a horizontal plane and that carries the cleaning head 60. The hydraulic drive mechanism 61 engages the cleaning head 60 only indirectly, that is, via the interposed cleaning carriage 62. In a sturdy construction designed for the intended application, the cleaning carriage 62 runs in rails 63 on the positioning frame 50, that is, on and crosswise to the straightening elements 48 of the positioning frame 50. To this end, relatively short pieces of the rails 63 are secured to the straightening elements 48 of the positioning frame 50, and running rollers 64 that are rotatably supported on the underside of the cleaning carriage 62 travel on these rails 63.

Figure 9:
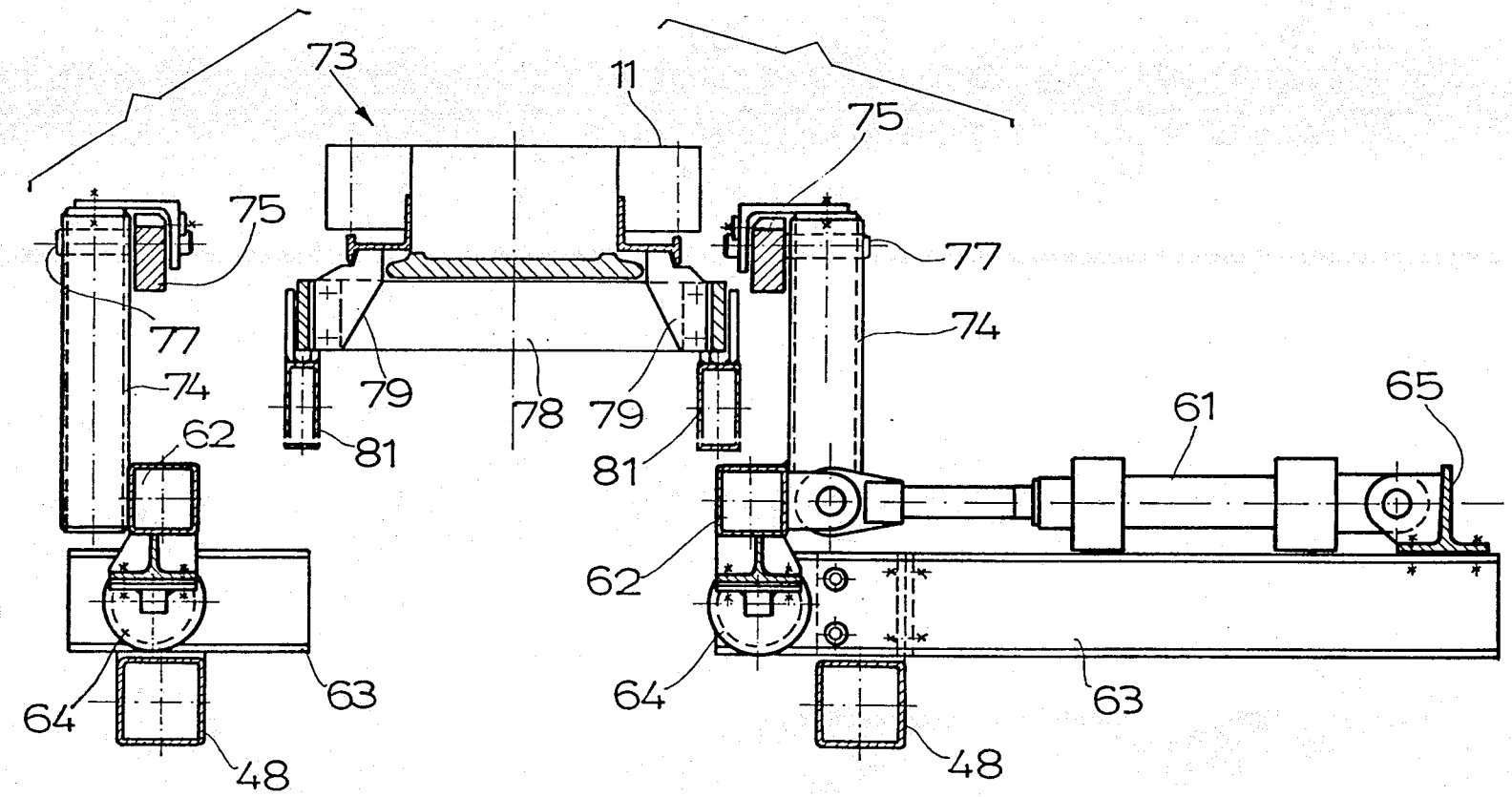
FIG. 9 shows the subject of FIG. 8 in a vertical section taken along the line IX—IX of FIG. 8.

FIGS. 7 and 9 taken together clearly show that the rails 63 are lengthened in the manner of an extension arm on one side of the positioning frame 50 and form an abutment 65 for the hydraulic drive mechanism 61 of the cleaning carriage 62. Proximity switches 66, 67 which are actuated without contact and are likewise disposed in the vicinity of the extensionlike lengthened portion of the rails 63 control the reciprocating movement of the cleaning carriage 62 and thus of the cleaning head 60 is well. To secure these switches 66, 67 in this location, a fastening plate 68 is provided on one of the rails 63. Serving as the influential element is a trip element 69 projecting from the cleaning carriage 62. Naturally the number of reciprocating movements of the cleaning carriage 62 can be varied as needed.

FIG. 8 shows still another special feature of the door frame cleaning device 16 realized in accordance with the invention. The cleaning head 60 is in fact not simple rigidly disposed on the cleaning carriage 62. Paying due attention to the problem of tolerances that is referred to several times above, the cleaning head 60 is instead disposed self-adjustingly on the cleaning carriage 62, by means of a link joint 70, which is held by a spring element 71 in a central normal position with this construction, it is assured that the cleaning head 60 will always rest with its scrapers 59 flush on the leveling door frame 12, within the intended tolerances.

In FIG. 10, the link joint 70 is shown on only one side of the cleaning head 60. It will be understood that the link joint 70 allows only a limited pivoting angle on the part of the cleaning head 60 relative to the cleaning carriage 62.

Referring now to FIGS. 8, 9, 10, and 11, only the door cleaning device realized in the cleaning apparatus according to he invention now remains to be described in detail.

In principle, it is conceivable for the same or a similar functional principle to be used in the door cleaning device 17 as with the door frame cleaning device 16 according to the preferred teaching of the invention. In the exemplary embodiment shown here, however, there is the problem with the leveling door 11 that the sealing faces which require cleaning are recessed, more or less being in the form of a continuous countersunk trench. A heat shield protrudes away from the leveling door 11 at the front. In order to accommodate this situation, the door cleaning device 17 is subdivided into a crosswise door cleaner 27 and a lengthwise door cleaner 73. The crosswise door cleaner 72 serves to clean the sealing faces of the leveling door 11 that extend crosswise to the longitudinal direction of the coking chamber 1, while the lengthwise door cleaner 73 serves to clean the sealing faces that extend in the longitudinal direction of the coking chamber 1. These conditions apply to the preferred exemplary embodiment of a leveling door 11, which when it is to be cleaned is located in a horizontal, or substantially horizontal, plane. In the event of other positions of the leveling door 11, naturally different subdivisions of the door cleaning device 17 must be made.

The crosswise door cleaner 72 of the door cleaning device 17, like the cleaning head 60 of the door frame cleaning device 16, executes a reciprocating movement crosswise to the longitudinal direction of the coking chamber 1. A further teaching of the invention therefore provides that the crosswise door cleaner 72 is realized as part of the door frame cleaning device 16.

In further detail, to attain this provision the cleaning carriage 62 of the door frame cleaning device 16 is provided with an upwardly projecting supporting frame 74 for the crosswise door cleaner 72. The crosswise door cleaner 72 has a holder 75 that is disposed on the supporting frame 74 and this holder 75 has scrapers 76 that can be brought into contact with the two sealing faces of the leveling door 11 that extend crosswise to the longitudinal direction of the coking chamber 1. The alternatives mentioned above for the scrapers 59 are also applicable here as alternatives to the scrapers 76. The holder 75 here is pivotable in rocker-like fashion about a centrally disposed pivoting shaft 77 supported on the supporting frame 74. As a result, self-adjustment with respect to the sealing faces of the leveling door 11 is provided for the scrapers 76 of the crosswise door cleaner 72 as well.

Accordingly, the result of the reciprocating movement of the cleaning carriage 62 is that the scrapers 59 on the cleaning head 60 move, effecting cleaning, over all the sealing faces on the leveling door frame 12, and that the scrapers 76 on the holder 76 move, effecting cleaning, over the sealing faces on the leveling door 11 that extend crosswise to the longitudinal direction of the coking chamber 1.

Figure 11:
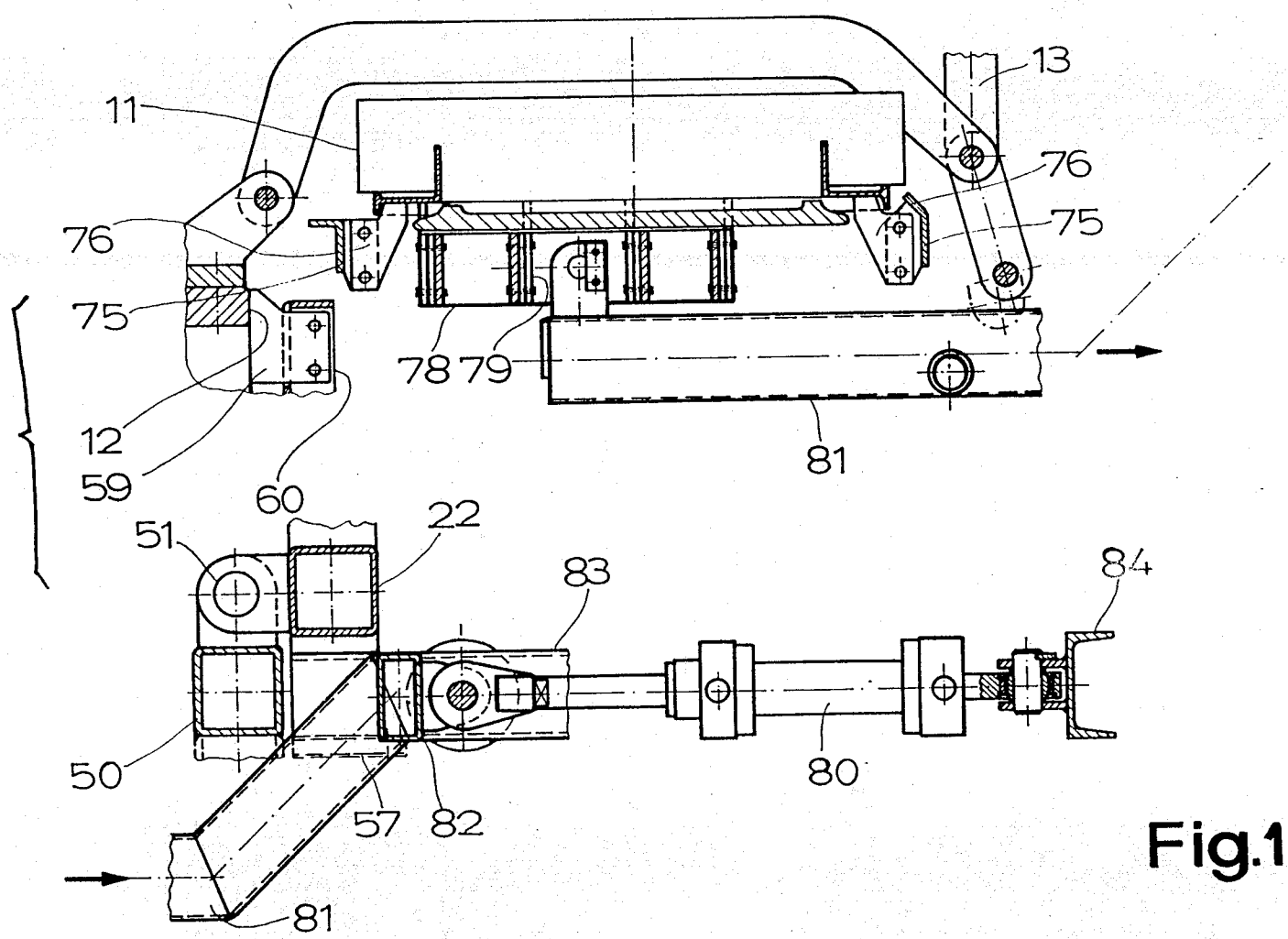
FIG. 11, in a highly schematic section taken in the vertical central plane, shows a lengthwise door cleaner of a door cleaning device of FIG. 1.

The lengthwise door cleaner 73 is embodied separately from the crosswise door cleaner 72; the lengthwise door cleaner is seen, at least in part, in FIGS. 9, 10 and 11. The lengthwise door cleaner 73 has a cleaning head 78, with scrapers 79 that can be brought into contact with the two sealing faces of the leveling door 11 that extend in the longitudinal direction of the coking chamber 1. The alternatives mentioned for the earlier scrapers apply to the scrapers 79 as well. For cleaning, the cleaning head 78 is movable back and forth in the longitudinal direction by means of a hydraulic drive 80 (FIG. 11). Naturally, this also applies to the preferred horizontal location of the leveling door 11 for cleaning.

The cleaning head 78 is disposed pivotably, in rocker-like fashion, about a central pivoting shaft on an extension arm 81 of a carriage 82 that is movable in the longitudinal direction of the coking chamber 1. The hydraulic drive 80 engages the carriage 82, so that the cleaning head 78 is moved back and forth in common with the extension arm 81 and the carriage 82. The number of movements effected by the hydraulic drive 80 is naturally selectable so as to attain an optimal cleaning effect. As in the earlier instances, here again a kinematic reversal is conceivable, that is, the cleaning head 78 can for instance be moved back and forth relative to the extension arm 81 by means of the hydraulic drive 80. However, the provision described first is more likely to be suitable for mechanical and structural conditions in a coking oven.

Proximity switches actuated in a non-contacting manner, not shown, are used for controlling the hydraulic drive 80; the securing flange 58 of such switches has already been shown, however, namely in FIG. 5.

Structurally, it is recommended that the carriage 82 be made to run in rails 83 secured on the positioning frame 50. This is schematically shown in FIG. 11, in which for the sake of clarity the securing flanges 57 for the rails 83 on the positioning frame 50 are also shown. The supporting frame 22 of the carrier 20 can also be seen in FIG. 11. In order not to have to shift the hydraulic drive 80 into the space below the cleaning head 78, the rails 83 are disposed on the side of the positioning frame 50 remote from the cleaning head 78; that is, they more or less protrude from the leveling door frame 12 away from the positioning frame 50. In common with the movement of the positioning frame 50, the rails 83 naturally move as well, so that an accurate lateral alignment of the cleaning head with respect to the leveling door 11 when the door 11 is in the position for cleaning is always assured.

FIG. 11 also shows that the rails 83 once again form an abutment 84 for the hydraulic drive 80 of the carriage 82.

In the construction selected according to the invention, the rails 83 protrude crosswise into the path of movement of the leveling rod 5 even when the carrier 20 is pivoted outward. This is not a problem, however, because the rails 83 are disposed above the path of movement of the leveling rod 5; thus when the carrier 20 has been pivoted outward, the leveling rod 5 passes beneath the rails 83 and the hydraulic drive 80. The need for this provision has necessitated a special construction of the extension arm 81. In fact, as shown in FIG. 11 this extension arm 81 must be shifted downward with respect to the carriage 82. Only then is it possible for the extension arm 81 to extend through the positioning frame 50 from the side remote from the cleaning head 78 and so retain the cleaning head 78 at the correct height relative to the leveling door 11.

From all the drawings it will be appreciated that the scrapers 59, 76, 79 are all interchangeable, namely being secured by screwing.

In closing, the functioning of the apparatus will be described again briefly:

First, the gripping claw 32 of the door opening device 14 is pivoted from the releasing position into the closing position, that is, until the proximity switch 39 in FIG. 3 emits a signal. This signal triggers the second hydraulic drive 43, which pivots the gripping claw 32 into the gripping position; the pivoting movement is terminated by a signal from the proximity switch 44. The reverse pivoting movement now begins, by means of the first hydraulic drive 38, until the insertion position is attained, at which the proximity switch 41 in FIG. 4 emits a signal. This signal triggers a hydraulic drive 90, not yet mentioned but shown in FIG. 1, for the main carriage 18. The main carriage 18 is moved forward on the main rails 19 toward the leveling door frame 12 until the positioning frame 15, by means of the run-on inclines 49 of the straightening elements 48 (FIG. 5), has correctly positioned the positioning frame 50 with respect to the leveling door frame 12. Now the door frame cleaning device 16 and the door cleaning device 17 are also located in their correct desired position, because both are adjustable with respect to the carrier 20 by means of the positioning frame 50.

By means of a limit switch (not shown), the signal for lowering the leveling door 11 into the position for cleaning is triggered. When the position for cleaning is reached, a signal of the proximity switch 40 is used for shutting the first hydraulic drive 38 back off. The cleaning cycle now begins, and selectively the door frame cleaning device 16 and the crosswise door cleaner 72 of the door cleaning device 17 can be put into operation, and after them the lengthwise door cleaner 73, or vice versa. Simultaneous operation is also possible. The reciprocating movement of the lengthwise door cleaner 73 is controlled by the proximity switch, not shown, which is adjusted on the securing flange 58 on the positioning frame 50, while the reciprocating movement of the cleaning carriage 62 along with the cleaning head 60 and the crosswise door cleaner 72 is controlled by the proximity switches 66, 67 (FIG. 7). After the cleaning cycle has been completed, with a predetermined, suitable number of cleaning strokes, the first hydraulic drive 38 is triggered once again, so that the leveling door 11 is brougth back into the insertion position, at which the proximity switch 41 emits a signal. This triggers the hydraulic drive 90, so that the main carriage 18 is retracted. By the retraction of the main carriage 18, the carrier 20 is pivoted outward relative to the main carriage 18, in the manner shown in FIG. 2, out of the path of movement of the leveling rod 5. After this outward pivoting movement is completed, the first hydraulic drive 38 is triggered yet again, and the gripping claw 32 is lowered as far as the closed position of the leveling door 11, at which the proximity switch 39 emits a signal. Along the last part of the way, there is an active actuation of the closing device 13 at the leveling door 11 (see FIG. 3). To complete the operation, the second hydraulic drive 43 is then actuated; the gripping claw 32 is pivoted into the releasing position, resulting in a signal by the proximity switch 45; and by actuating the first hydraulic drive 38 the rod linkage 31 having the gripping claw 32 is pivoted back until it reaches the position of repose shown in FIG. 4, producing a signal by the proximity switch 42.

Naturally the door opening device 14 can be actuated in the same manner whenever the leveling rod 5 of the leveling device 4 is to be inserted into the coking chamber 1.

What is claimed is:

1. A coking oven with at least one coking chamber, comprising said coking chamber of said coking oven having a leveling door frame around a leveling hole in one side of said coking chamber and a leveling door closing against said leveling door frame, said leveling door having a closing device and being hinged to swing outwardly and upwardly to open, a coke pushing machine for leveling coke in said chamber, said coke pushing machine having mounted thereon means for opening and closing said leveling door of said coking chamber a leveling device, and a cleaning apparatus for cleaning the leveling door and the leveling door frame of said coking chamber, said coke pushing machine being located on said side of said coking chamber in which said leveling hole is provided and being movable in a longitudinal direction along said side thereof to be positioned in alignment with said coking chamber, said means for opening and closing said leveling door on said coke pushing machine being such as to swing said leveling door of said chamber out and up to an open position and to keep said leveling door in said open position for leveling and cleaning, said leveling device comprising a leveling rod and first moving means supporting said leveling rod on said coke pushing machine, said first moving means moving said leveling rod in relation to said coke pushing machine along a straight path of motion from a retracted position on said coke pushing machine straight towards and into said leveling hole for performing leveling in said coking chamber when said coke pushing machine is positioned in alignment with said coking chamber and said leveling door is open, and for withdrawing said leveling rod straight out of said leveling hole back into said retracted position after performance of leveling, and said cleaning apparatus comprising a main carriage placed on said coke pushing machine and mounted on second moving means for being moved relative to said coke pushing machine along a straight path of motion towards and away from said leveling hole when said leveling door is open, a swiveling carrier hinged on a vertical side of main carriage to be swung horizontally between a first position at the side and clear of said path of motion of said leveling rod and a second position opposite said leveling hole and in said path of motion of said leveling rod, positioning means movably mounted on said swiveling carrier, and cleaning means mounted on said positioning means and thus being movable with respect to the swivelling carrier for positioning with respect to said leveling door frame and said leveling door for cleaning said leveling door frame and said leveling door of said coking chamber, wherein said means for opening and closing said leveling door has a rod linkage that is pivotable in a vertical plane and a gripping claw pivotably articulated on said rod linkage and pivotable relative to said rod linkage in a vertical plane, for gripping said closing device of said leveling door, said rod linkage being disposed at the side and clear of said path of motion of said leveling rod and said rod linkage having an extension arm overlappng said path of motion of said leveling rod, said extension arm carrying said gripping claw, wherein leveling and cleaning are performed at different times while said leveling door is kept open by said means for opening and closing said leveling door, wherein when a cleaning operation is to be performed for said leveling door frame and said leveling rod is withdrawn into said retracted position, said swiveling carrier is swung into said second position, said cleaning means by way of said positioning means is positioned with respect to said leveling door and said leveling door frame, and said cleaning means is operated to perform cleaning, and wherein a control slot is placed fixedly and stationarily on said coke pushing machine, said swivelling carrier comprising a pivot lever that is rigidly connected to said swivelling carrier, a free end of said pivot lever riding in said stationary control slot so that when said main carriage is moved towards and away from said leveling hole said swivelling carrier is automatically swung between said first and second positions.

2. The cleaning apparatus of claim 1, wherein said control slot is disposed above said path of motion of said main carriage.

3. The coking oven of claim 1, wherein said swivelling carrier comprises a vertically oriented bearing shaft supported at said vertical side of said main carriage and a supporting frame protruding away from said bearing shaft and located substantially in a vertical plane, said positioning means being mounted on said supporting frame.

4. The coking oven of claim 1, wherein said leveling door frame has two straightening faces, and said positioning means has two straightening elements protruding in tinelike fashion towards said leveling door frame that can be brought to rest against the straightening faces of said leveling door frame, wherein said straightening elements are part of a torsionally rigid positioning frame, and wherein said positioning frame is supported adjustably crosswise to the direction of extension of said straightening elements on said swivelling carrier.

5. The coking oven of claim 4, wherein said positioning frame has a respective bearing shaft on an upper edge thereof, said bearing shaft is retained at least centrally in a block secured on said positioning frame, and said bearing shaft is slidably guided in bearing eyes of said swivelling carrier that are located on both sides of said central block.

6. The coking oven of claim 5, comprising spring elements operatively connected between said swivelling carrier and said positioning frame, wherein adjustment of said positioning frame relative to the swivelling carrier is affected counter to a spring force of said spring elements in such a manner to predetermined a central normal position of said positioning frame.

7. THe coking oven of claim 6, wherein said spring elements are disposed between said central block and the respective adjacent ones of said bearing eyes.

8. The coking oven of claim 1, said closing device comprising a closing hook mounted on said leveling door frame, and a bracket-like two-arm lever pivotably articulated on said leveling door, wherein said two-arm lever grips said closing hook on said leveling door frame from behind with one lever arm, and provides a point of application for said gripping claw with the other lever arm.

9. The coking oven of claim 8, wherein said gripping claw has a downwardly curving control surface that, during a closing movement, comes to rest at the end of said other lever arm, said control surface allowing said other lever arm to be pressed downward to the direction of said leveling door frame.

* * * * *